US006565228B2

(12) United States Patent
Nguyen

(10) Patent No.: US 6,565,228 B2
(45) Date of Patent: May 20, 2003

(54) SLANT CONTAINER FOR STORING AND ADVERTISING AN ARTICLE OF CLOTHING

(75) Inventor: Chao Nguyen, Boca Raton, FL (US)

(73) Assignee: BBC International, Boca Raton, FL (US)

( * ) Notice: Subject to any disclaimer, the term of this patent is extended or adjusted under 35 U.S.C. 154(b) by 0 days.

(21) Appl. No.: 09/755,471

(22) Filed: Jan. 5, 2001

(65) Prior Publication Data

US 2002/0089847 A1 Jul. 11, 2002

(51) Int. Cl.[7] ..... F21V 33/00

(52) U.S. Cl. ..... 362/154; 362/155; 362/156; 362/125

(58) Field of Search ..... 362/154, 155, 362/156, 125; 206/767, 278, 752

(56) References Cited

U.S. PATENT DOCUMENTS

| | | | | |
|---|---|---|---|---|
| 370,540 A | | 9/1887 | Hodge | |
| 2,102,077 A | | 12/1937 | Kahn | 229/8 |
| 2,168,240 A | | 8/1939 | Roberts | 206/44 |
| 2,502,561 A | * | 4/1950 | Ebert | 206/750 |
| 2,980,308 A | | 4/1961 | Bolding | 229/31 |
| 5,243,504 A | * | 9/1993 | Sejzer | 362/104 |
| 6,305,533 B1 | * | 10/2001 | Welty et al. | 206/278 |

FOREIGN PATENT DOCUMENTS

WO PCT/US00/23929 9/2000

* cited by examiner

*Primary Examiner*—Sandra O'Shea
*Assistant Examiner*—Guiyoung Lee
(74) *Attorney, Agent, or Firm*—Darby & Darby

(57) ABSTRACT

A container for storing an article of clothing having a tag for displaying an individual advertisement. The container is generally rectangular with top and bottom portions. When closed the container retains its rectangular shape but it has a slanted shape when opened and the top is stored below the bottom, such that the front of the container is lower than the rear of the container. A tag is pivotally connected to the bottom of the container with a large section distally located from the pivot. When the tag is pivoted outward of the opened container, the large section of the tag is suspended outside the front wall of the container. An LED may be mounted on the tag to allow for visual perception of the advertisement at a substantial distance from the container.

18 Claims, 2 Drawing Sheets

SLANT CONTAINER FOR STORING AND ADVERTISING AN ARTICLE OF CLOTHING

FIELD OF THE INVENTION

The invention relates to a container, and more specifically, to a container combined with means to facilitate visual exposure of the contents of the container and advertising material thereon.

BACKGROUND OF THE INVENTION

The invention is directed to the supplying of shoes in boxes and the like wherein a tag is hanging from the box for displaying advertisements that emphasize the importance of the contents of the box.

When a manager of a department s tore wants to advertise a product, such as shoes, there are several routs that the manager can take. For example, the manager may advertise internally or externally. An external advertisement includes, for example, those found in a newspaper or other periodical, or that on commercial television, cable, radio or Internet source. An internal option includes a large, generally directed sign which may comprise at least one flashing light. An internal advertisement may also consist of a circular which a customer attains upon entering the department store. A circular, for example, generally contains information on store sales as well as coupons for specific items.

The external advertisements bring the customer into the retail store and the internal techniques may grab the attention of the customer who has entered the store for reasons unrelated to any sale. However, store managers would find that each of the mentioned external advertising efforts have problems with respect to the actual impact on sales of a targeted product. Similar problems exist when the manager bombards the customer with an array of internal advertisements. Especially in a large department store, not one of the mentioned efforts assures the manager that the customer will look for or find the product.

One reason for the failure of current advertisements is that in a large department store, the manager is forced to display similar types of goods in similar locations. The manager may have targeted a particular good in an advertisement or a sign, which may bring the customer to a row of similar goods. The customer may walk toward a specific product in this row of similar goods, and lose focus as to which of the goods was the targeted item. In a row of shoes, for example, an adjacent grouping of shoes may blend together such that the customer loses the ability to hone in on an advertised pair of shoes. This problem may occur regardless of how many advertisements a manager utilizes in an effort to sell a pair of a particular brand of shoes.

Managers and marketing personnel have sought to overcome the mentioned problems with the current art in different ways. For example, a manager may place an individual style of shoe in a location which is separated from the rest of the shoe selections, and include a large advertisement emphasizing the importance of the sale of the particular product. A manager may also place individual signs and tags on each shoe, perhaps including red dots or other implements which attempt to indicate the sale.

The solution of individually locating the targeted shoes has an inherent problem. Space is limited in any store, so that selectively advertising many goods in this fashion is usually prohibited. For example, if there are dozens of shoes in a crowded department store's shoe department or a speciality shoe store and a manager wishes to distinguish a group of shoes, selectively placing shoes, which are "on sale" in a temporary area to distinguish them from others, may not be feasible.

The solution of individual signs and tags also has problems when considering the influence on customers and the impact on sales. Most individual signs and tags are not effective because they are not placed directly in the line of sight of a customer walking down the row of goods. Even tags that are placed directly in the line of sight of the customer usually fail to grab the attention of the customer. These tags are not sufficiently interesting to cause the customer to notice them and thus induce the customer to examine the goods.

SUMMARY OF THE INVENTION

To address the problems in the art, it is an object of the present invention to provide a box which is designed such that a maximum amount of the product stored within the box is visible to a customer when viewed from the front of the box, while the lid of the box is not in place.

It is another object of the present invention to provide an implement, such as a hanging tag, for locating an individual advertisement directly in the line of sight of the customers. It is a further object of the present invention to make this implement attractive to customers walking past the advertised goods. Further, this implement may be reusable in that it remains with the box of goods.

It is a further object of the present invention to provide this implement in a form which saves storage space, as it is permanently and easily stored within the box of the advertised goods. This easy storage further provides the advantage that the implement does not interfere with the advertisement of other goods during selected periods of time, such as when the goods associated with the particular implement are not on sale.

According to an illustrative embodiment of the present invention, the foregoing objects are achieved with a slant container for storing and advertising an article of clothing, e.g., shoes, comprising a top half and a bottom half. The top half has a rectangular top surface and two depending side panels and two depending end panels. The bottom half has a bottom surface and two upwardly projecting side panels and two end panels. A front end panel of the bottom is smaller in height than the back end panel, and the bottom side panels slope downwardly from the back end panel to the front end panel. The top half has a larger front panel and a smaller back panel. The side panels of the top have slopes from the back to the front so that when the top half is selectively laid over the bottom half, the depending panels of the top half enclose the corresponding projecting panels of the bottom half, and the resulting container forms a rectangular parallelepiped. However, when the top half is rotated 180° and stored under the bottom half, the bottom edges of the depending panels of the top half approximately meet the top the edges of the projecting panels of the bottom half. Further, in the orientation with the top under the bottom, the sloping shape allows the contents of the container to be easily viewed, e.g., from a store isle, because the front panel has a reduced height.

The container may further include a tag with a large surface extending in two dimensions and an elongated surface attached to one side of the large surface, e.g., perpendicular thereto. The elongated surface is attached to the bottom half of the container via a pivot. The elongated surface is dimensioned so that when the large surface is selectively pivoted to the maximum outward rotational distance, the large surface is suspended outside of the bottom half. The large surface is dimensioned so that the two dimensional face is large enough for an individual advertisement to be selectively placed on the face and small enough so that when the large surface is selectively pivoted to the maximum inward rotational distance, the large surface fits within the container.

The large surface of the tag has mounted thereon at least one LED which protrudes from at least one side of the large surface. The LED is large enough and emits a light intensity bright enough to allow for visual perception from a substantial distance from the tag. The LED is small enough to not interfere with the advertisement placed on the tag. The container further comprises an integrated circuit to power the LED. The integrated circuit and a power source, may be retained in a cube from which wires extend and pass into the tag to the LED. The related casing is stored on the inside panel of the bottom half.

The embodiment of the invention, as described, provides for a container which, due to its slanted sides, allows for a maximum allowable viewing of stored goods. The lighted tag when pivoted out of the open container attracts customers so that they may read advertisements placed on the tag. This assures that customers will notice the products within the container. The pivot attachment on the tag allows the tag to be selectively and efficiently stored and used.

BRIEF DESCRIPTION OF THE DRAWINGS

Still other advantages of the present invention will become more readily apparent to those skilled in this art from the following detailed description, wherein is shown and described only the preferred embodiment of the invention, simply by way of illustration and in which.

DETAILED DESCRIPTION

Figure 1:
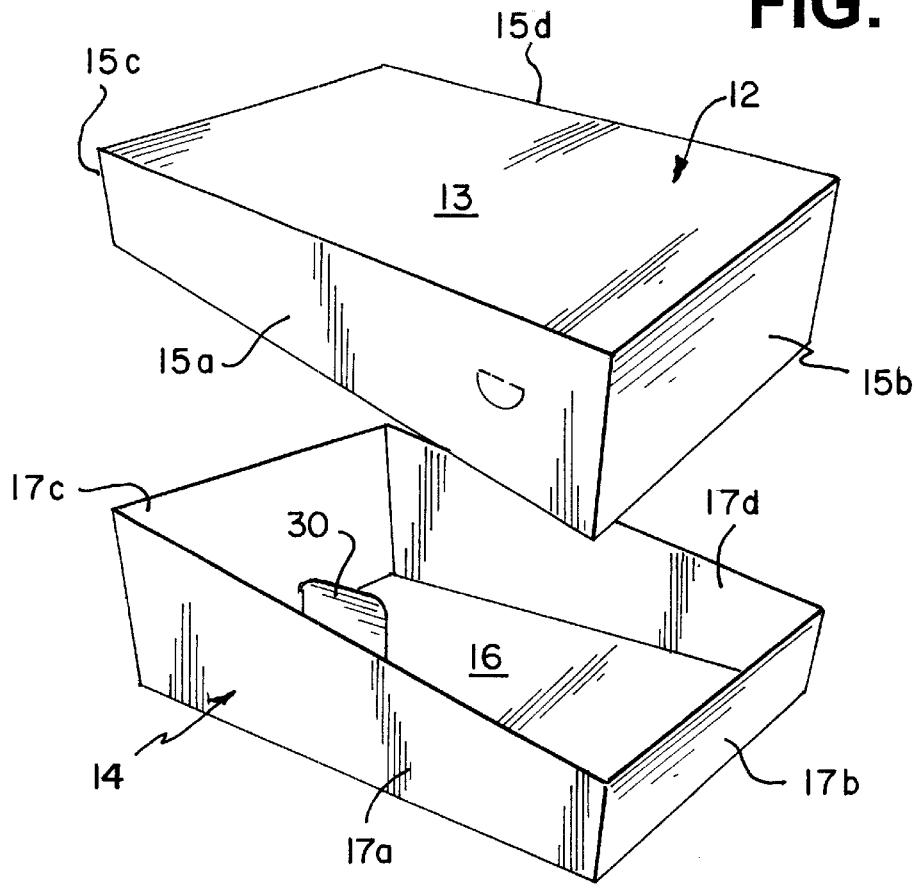
FIG. 1 is a perspective exploded view of a preferred embodiment of the top half and bottom half of a container according to the present invention.

FIG. 1 shows a slant container for storing and advertising an article of clothing according to an embodiment of the invention. The clothing which may be chosen for packaging in the container may consist of shoes, boots, sandals, shirts, pants, or any other article of clothing which may be fitted into a container for display in a store.

The container has a top half 12 composed of a semi-rigid, non-conductive material, having a rectangular top surface 13 and two downwardly depending side panels and two downwardly depending end panels. The end panels consist of a front end panel 15*b* and a rear end panel 15*c*. Each end panel is attached to the top surface 13 on opposing narrow edges of the top surface 13, spanning the length of the narrow edge. The front panel 15*b* extends further, i.e., has a greater height, than the rear panel 15*b*, and each end panel is rectangular. The side panels consist of a third side panel 15*a* and a fourth side panel 15*b*. Each side panel is attached to the top surface 13 on opposing wide edges of the top surface 13, spanning the length of the wide edge. Each side panel is trapezoidal so that adjacent edges between the side panels and the end panels have equal lengths.

The container further includes a bottom half 14, composed of a semi-rigid, non-conductive material. The bottom half consists of a rectangular bottom surface 16 and two upwardly projecting side panels and two upwardly projecting end panels. Each upwardly projecting side and end panel corresponds to an opposing downwardly depending side and end panel. The side panels consist of a front 17*b* and a rear end panel 17*c*. Each end panel is attached to the bottom surface 16 on opposing narrow edges of the bottom surface, spanning the length of the narrow edge. The rear panel 17*c* is longer, i.e., has greater height, than the front panel 17*b*, and each panel is rectangular. The side panels also consist of a third side panel 17*a* and a fourth side panel 17*b*. Each side panel is attached to the bottom surface 16 on opposing wide edges of the bottom surface 16, spanning the length of the wide edge. Each side panel is trapezoidal so that adjacent edges between the side panels and the end panels have equal lengths.

Figure 2:
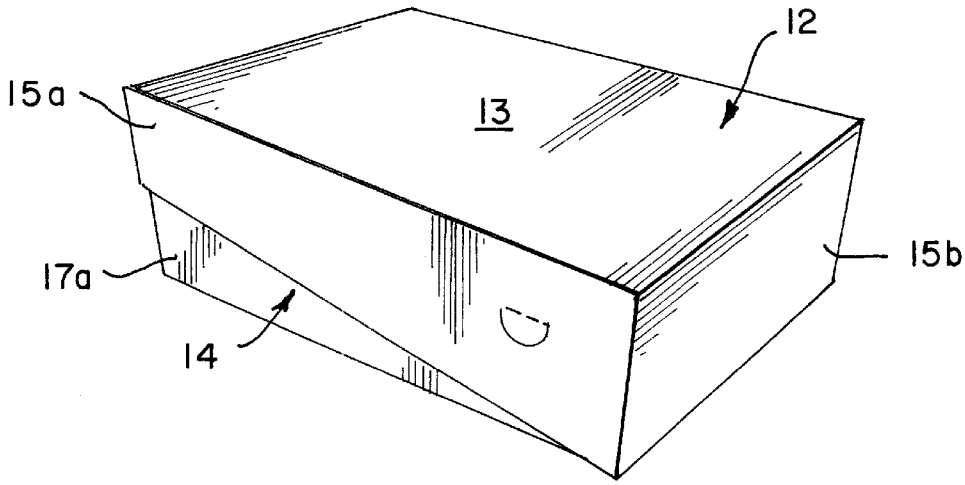
FIG. 2 is another perspective view of a preferred embodiment of the top half and bottom half of the invention with the top half located on the bottom half.

The bottom half 14 is dimensioned such that when the top half 13 is selectively laid over the bottom half 14 so that the inside surface of the upper surface 13 faces the inside of the bottom surface 16 (FIG. 2), the depending panels of the top half 12 enclose the corresponding depending panels of the bottom half 14. The resulting container forms a rectangular parallelepiped. When the top half 12 is selectively stored under the bottom half 14 (FIG. 3), the bottom edges of the depending panels of the top half 12 approximately meet the top the edges of the depending panels of the bottom half 14. This storage is attained by inverting the top half 12, rotating it by 180° and placing the bottom half 14 within the upper half 12 so that the inside face of the front panel of the top half 15*b* is adjacent to the outside face of the rear panel of the bottom half 17*c*.

The material for the container may be chosen from cardboard, plastic, or the like. The shaped design for the container allows for an enhanced visual perception of the goods, such as shoes, stored within the container. When a customer in a store walks past the shelf with a pair of shoes located in this container, with the front of the container facing the customer and the top half 12 being stored under the bottom half 14 as described, the container allows for a maximum amount of visibility to the shoes. Comparatively, when a customer walks past a shelf with a pair of shoes in a container that has only rectangular side panels of the same height, the customer often sees only the panels of the container.

The design is also preferred because it has a strength which mimics that of a container with only rectangular side panels. When the top half 12 is covering the bottom half 14 (FIG. 2), the container allows for a maximum shipping and crushing strength, and requires the same storage space as conventional shoe boxes.

Figure 3:
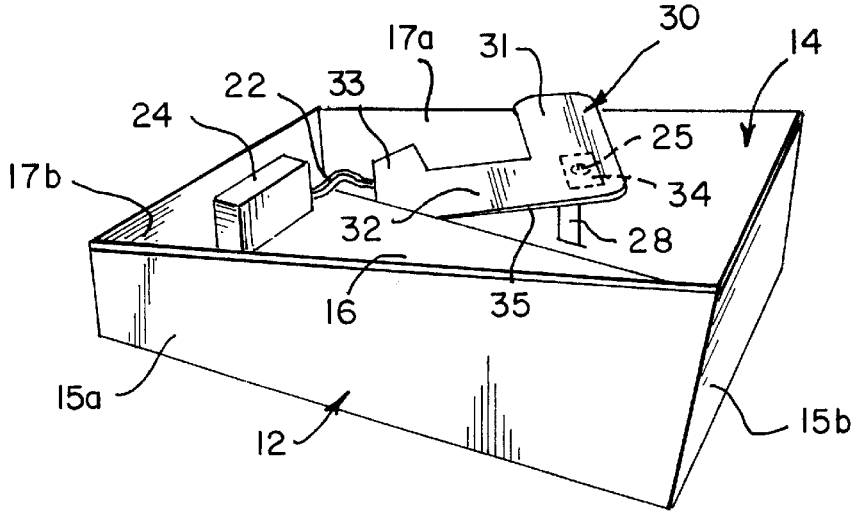
FIG. 3 is a right side perspective view of an embodiment of the bottom half, tag and power supply according to an embodiment of the invention.

The container may also be provided with a tag 30, that is made of a semi-rigid and nonconductive material. As shown in FIG. 3, the tag 30 has a large surface 31 extending in two dimensions with a nominal thickness, and an elongated surface 32 perpendicular thereto. One end of the elongation 32 is attached to the bottom half 14 by a pivot 33. The pivot attachment 33 is on an inwardly facing surface of either of the side panels on the bottom half 14, such that the plane parallel to the face of the large surface 31 is parallel to the plane parallel to the face of either side panel of the bottom half 14. The pivot attachment 33 allows the large surface 31 to pivot inward and outward from the inside face of the bottom surface 16.

Figure 4:
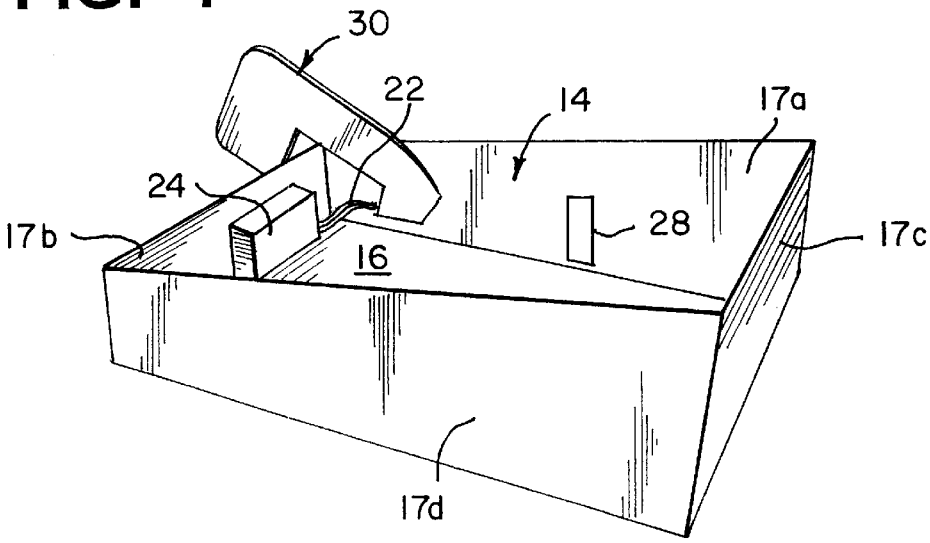
FIG. 4 is a right side perspective view of an embodiment of the bottom half, tag and power supply according to an embodiment of the invention with the tag pivoted out of the bottom half.
Figure 5:
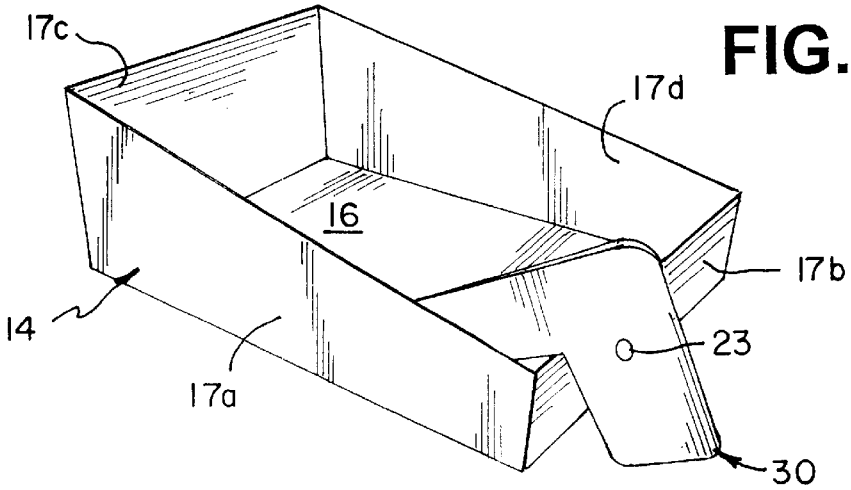
FIG. 5 is a left side perspective view of a preferred embodiment of the invention showing the bottom half and tag.

The elongated surface 32 is dimensioned so that when the large surface 31 is selectively pivoted to the maximum outward rotational distance, the large surface 31 is suspended outside of the bottom half 14 and is supported by at least two points: a first point being the pivot attachment 33; and a second point being where the edge of the elongated surface 32 then contacts the top edge of the front face 17*b* of the bottom half 14 (FIGS. 4 and 5). The large surface 31 is dimensioned so that the two dimensional face is large enough for an individual advertisement to be selectively placed on the face 31 and small enough so that when the large surface 31 is selectively pivoted to the maximum inward rotational distance (FIG. 3), the large surface 31 fits within the container.

The material used for the tag 30 could be the same or different from that used for the other container parts. The large surface 31 may be the same or different material from the elongated surface 32. The elongated surface 32 may be, for example, planarly cylindrically or rectangularly shaped. The shape for the large surface 31 on the tag 30 could be any two dimensional shape which may be utilized for an advertisement. For example, the shape could be square, rectangular, octagonal, hexagonal, circular, elliptical, and any other desired two dimensional design.

As compared to individual tags known in the prior art, placement and design of the tag 30 allows for easy storing and usage of the tag 30. For example, if a label which advertises a sale of a pair of shoes is provided, the tag 30 on the container may be flipped outward so that the advertisement may be readily attached and viewed from the isle by customers. If only certain pairs of shoes are on sale, tags for those shoes may be flipped outward while all other tags remain or are flipped inward. This way, only tags indicating a sale may be visible to customers, minimizing any possible confusion as to which shoes are being promoted.

The tag of the inventor may also include at least one light emitting diode or LED 23 (FIG. 5). The LED 23 is mounted on the large surface 31 of the tag 30 such that the LED 23 protrudes from at least one side of the large surface 31. The LED 23 is large enough and emits a light intensity bright enough to allow for visual perception at a substantial distance from the tag 30. The LED 23 is small enough so that it does not interfere with the advertisement placed on the tag 30. The container further comprises an integrated circuit (not shown) to power the LED 23. The integrated circuit and a power source (e.g. a battery) may be located in a case 24 and connected to the LED 23 by wires 22. The case 24 is mounted in the bottom half 14 as shown in FIGS. 3 and 4. In alternative embodiments, the power source may be a typical alternating current source, or perhaps a direct current source other than a battery, e.g., a solar power source.

The LED 23 allows for clear and distinct visual perception of the advertisement on the tag 30. The LED 23 and tag 30, in combination, provide an accentuation to a particular item, such as a pair of shoes, which would otherwise be practically unnoticeable in a sea of similarly situated goods. In a department store or speciality store with thousands of items on sale, an individual tag 30 with an LED 23 is clearly a needed implement to further the sales of any particular product.

In an alternative embodiment, the integrated circuit comprises a slow rate oscillator or pulse generator, so that a continuous current pulse flows to and illuminates the LED 23. The effect of this pulsating LED 23 is to emphasis the advertisement on the tag 30 as well as the goods within the container. A pulsating LED 23 is likely to attract the attention of those who are more affected by a varying stimulus.

In an alternative embodiment, the tag is made of folded material or two pieces of material, so that it has two parts or sides, with one edge 35 being open and the other side, representing the fold, being closed. Electrical contacts 25 are provided within the opening on opposite parts of the tag. Contacts 25 are connected to the wires 22. Under normal circumstances, the tension in the tag causes its two parts to close upon each other sufficiently that the contacts 25 touch each other and complete an electrical connection. However, a piece of non-conductive 34 may be placed in the open side to keep the contacts 25 separated from each other, thus breaking the electrical connection. This will prevent the LED 23 from flashing, when not necessary. Further, the wires 22 can be arranged so that the power source is disconnected when the non-conductive material 34 is in place, thus saving power, e.g., during shipping.

In a still further embodiment, the container includes a small non-conductive and semi-rigid piece of material 28. The small material 28 is integrally connected to the same panel as the tag 30 at an area of the small material 28 closest to the bottom surface 16. The small material 28 is located and dimensioned so that when the large surface 31 is selectively pivoted a maximum inward rotational distance, the top area of the small material 28 becomes inserted into the opening 35 in the tag 30 and breaks the connection between contacts 25 (FIG. 3). The integrated circuit is thus opened so that the LED 23 does not flash, and battery power may also be totally disconnected. (This alternative embodiment allows for a power saving feature which would decrease overhead expenses related to utilizing the invention.)

In an embodiment, the power source is an alternating current (A.C.) source. If an A.C. source is used, a business saves not only on batteries, but also on compensation to workers who take time to monitor and replace the batteries.

As will be realized, the invention is capable of other and different embodiments from those set forth in the foregoing specification, and its several details are capable of modifications in various respects, all without departing from the invention. Accordingly, the drawing and description are to be regarded as illustrative in nature, and not as restrictive. The invention is limited only by the following claims.

What is claimed is:

1. A slant container for storing and advertising an article of clothing comprising:

a top half having a rectangular top surface and two depending side panels as well as front and back depending end panels, all of said depending panels being generally perpendicular to said top surface, said depending side panels being on opposite sides of said top surface and said depending end panels being on opposite sides of said top surface different from said side panels, said depending front end panel having a larger height than said depending back end panel, said side panels sloping from said depending back end panel to said depending front end panel;

a bottom half having a rectangular bottom surface and two projecting side panels as well as front and back projecting end panels, all of said projecting panels being generally perpendicular to said bottom surface, said projecting side panels being on opposite sides of said bottom surface and said projecting end panels being on opposite sides of said bottom surface different from said side panels, said projecting front panel having a smaller height than said back panel, said side panels sloping from said projecting back end panel to said projecting front end panel, said bottom half being dimensioned such that when the top half is selectively laid over the bottom half the inside surface of the upper surface faces the inside of the bottom surface, the depending panels of the top half enclose the corresponding projecting panels of said bottom half, and the resulting container forms a rectangular parallelepiped;

a tag having a large surface extending in two dimensions with a nominal thickness and having an elongated surface attached at an angle thereto; and a pivot attached to a projecting side wall of the bottom half and attached to the large surface of said tag to pivotally mount said tag on said bottom half for rotation between an inner position in which the tag is completely within said bottom half and an outer position in which at least the large surface of said tag extends over the upper edge of the projecting front end of said bottom portion.

2. A container as defined in claim 1, further comprising:

at least one powered light emitting diode (LED) is mounted on the large surface of the tag such that the LED protrudes from at least one side of the large surface, upon operation the LED emitting light bright enough to allow for visual perception at a distance from the tag, the LED is small enough to not interfere pivoting the tag into the bottom half.

3. A container as defined in claim 1, wherein the large surface is dimensioned so that the two dimensional face is large enough for an individual advertisement to be selectively placed on the face and small enough so that when the large surface is selectively pivoted to the maximum inward rotational distance, the large surface fits within the container.

4. A slant container as defined in claim 1, wherein when the top half is selectively stored under the bottom half, the bottom edges of the depending panels of the top half approximately meet the top the edges of the projecting panels of the bottom half, the storage is attained by inverting the top half, rotating the top half by 180° and placing the bottom half within the upper half so that the inside face of the front panel of the top half is adjacent to the outside face of the rear panel of the bottom half.

5. A container as defined in claim 1 wherein the large surface of the tag supports an advertisement.

6. A container as defined in claim 1, wherein each end panel is rectangular and each side panel is trapezoidal so that adjacent edges between the side panels and the end panels have equal lengths.

7. A container as defined in claim 6 wherein the pivot attachment is located on an inwardly facing surface of either of the side panels on the bottom half, such that the plane parallel to the face of the large surface is parallel to the plane parallel to the face of either side panel of the bottom half, the attachment allows the large surface to pivot inward and outward from the inside face of the bottom surface.

8. A container as defined in claim 7 wherein the elongated surface is dimensioned so that when the large surface is selectively pivoted to the maximum outward rotational distance, the large surface is suspended outside of the bottom half by at least the pivot attachment and a point where the edge of the elongated surface contacts the top edge of the front face of the bottom half.

9. A container for advertising a product comprising:

a top half with a top surface and depending panels defining an interior chamber;

a bottom half with a bottom surface and depending panels defining an interior chamber, wherein the top half partially receives the depending panels of the bottom half into the interior chamber of the top half; and alternately, the interior chamber of the top half, when inverted, receives the bottom surface of the bottom half;

a tag pivotally attached to the side panel, the tag being pivotal between a first position and a second position; and a light emitting diode (LED) attached to the tag having an on mode and an off mode, wherein, the tag in the first position is disposed in the interior chamber of the bottom half and the LED is in the off mode, and wherein the tag in the second position is disposed outside the interior chamber of the bottom half and the LED is in the on mode.

10. A container as defined in claim 9, wherein the container is comprised of a semi-rigid, non-conductive material.

11. The container as described in claim 9, wherein the second position is allowed when the top half does not enclose the bottom half.

12. The container as described in claim 9, wherein the tag is permanently attached to the bottom half.

13. A container as defined in claim 9, further comprising:

a power source to power the LED; and an integrated circuit to control the supply of power to control the illumination of the LED; and wires for connecting the integrated circuit, power source and LED.

14. A container as defined in claim 13, further comprising a case in which said integrated circuit and at least a portion of said power source are located, said case being located on the inside of one of the depending panels of the bottom half.

15. A container as defined in claim 13, wherein the integrated circuit further comprises:

at least one of a slow rate oscillator and pulse generator, so that a continuous current pulse flows to and periodically illuminates the LED.

16. A container as defined in claim 13, wherein the power source on the integrated circuit is a battery.

17. A container as defined in claim 13, wherein said tag is comprised of two material layers arranged side by side with an opening along at least one side; and further comprising:

two electrical contacts in series with said wires and located adjacent each other on the inner surfaces of said material layers of said tag so as to generally be in contact with each other, thus allowing the LED to be operated; and a piece of non-conductive material dimensioned larger then the contacts so that when the non-conductive material is positioned in the opening along the side of the tag and between said electrode, operation of the LED is inhibited and power is saved.

18. A container as defined in claim 17, wherein said non-conductive material is a small non-conductive and semi-rigid piece of strip integrally connected to the same panel as the tag at an area of the strip closest to the bottom surface, the strip being located and dimensioned so that when the tag is selectively pivoted to its first position the top area of the strip becomes inserted into the opening in the tag and positioned between the contacts.

* * * * *